United States Patent [19]

Villeneuve et al.

[11] 4,249,435

[45] Feb. 10, 1981

[54] WORKPIECE TURNING HAND TOOL WITH TORQUE CONTROL

[76] Inventors: Norman R. Villeneuve, 84 Newgate Rd., East Granby; William J. Smith, 17 Mildred Rd., West Hartford, both of Conn.

[21] Appl. No.: 61,856

[22] Filed: Jul. 30, 1979

[51] Int. Cl.[3] ..... B25B 23/142

[52] U.S. Cl. ..... 81/477; 81/58.3; 81/58.4; 81/480

[58] Field of Search ..... 81/52.4 R, 58.3, 58.4

[56] References Cited

U.S. PATENT DOCUMENTS

| | | | |
|---|---|---|---|
| 2,707,893 | 5/1955 | Bohnet | 81/58.3 |
| 3,272,246 | 9/1966 | Bohnet | 81/58.3 |

FOREIGN PATENT DOCUMENTS

| | | | |
|---|---|---|---|
| 925220 | 3/1955 | Fed. Rep. of Germany | 81/52.4 R |
| 597393 | 1/1948 | United Kingdom | 81/52.4 R |
| 638055 | 5/1950 | United Kingdom | 145/76 |

*Primary Examiner*—James L. Jones, Jr.

*Attorney, Agent, or Firm*—McCormick, Paulding & Huber

[57] ABSTRACT

A tool for turning a screw, nut, bolt or other rotatable workpiece includes a bottom housing carrying a workpiece engageable part and, above the housing, a handle engageable by the hand of a user. The handle is axially and angularly shiftable relative to the housing and is angularly connectable to the housing through both a torque spring and through sets of angular stops on the housing and on the handle which stops are brought into and out of engagement with one another as the handle is shifted axially relative to the housing. The tool may be used as an ordinary screw driver or wrench whereby hand torque is transmitted directly from the handle to the housing, as a torque measuring tool whereby hand torque is transmitted from the handle to the housing through the torque spring, and as a preloaded tool whereby a given amount of torque is loaded into the tool prior to application to the workpiece and then, after application of the tool to the workpiece, is released and used to rotate the workpiece without the handle being rotated by the user.

10 Claims, 12 Drawing Figures

WORKPIECE TURNING HAND TOOL WITH TORQUE CONTROL

BACKGROUND OF THE INVENTION

This invention relates to a hand tool for use in turning rotatable workpieces, and deals more particularly with such a tool which is shiftable between different modes of operation and which includes a torque spring that may be used to control the amount of torque applied to the workpiece.

The general object of this invention is to provide a hand tool for use in turning rotatable workpieces, which may be made in any convenient size at relatively low cost and which is highly versatile insofar as having a number of different modes of operation which may be quickly and easily brought into and out of play.

More particularly, the object of this invention is to provide a tool of the foregoing character which may be used as an ordinary screw driver, socket wrench, or the like to transmit hand torque directly to the workpiece, which may be used as a torque screw driver, wrench or the like to transmit a measured amount of torque to the workpiece, or which may used as a preloadable tool to transmit to the workpiece an amount of torque preloaded into the tool by hand prior to its being brought into engagement with the workpiece.

Another object of the invention is to provide a hand tool of the foregoing character wherein the torque spring is easily interchangeable with other different torque springs to provide different torque characteristics for the tool.

A still further object of the invention is to provide a tool which is adaptable to turn screws or other rotatable workpieces in confined or limited space conditions where it is difficult or impossible to turn the workpiece by rotating the handle of the tool.

Other objects and advantages of the invention will be apparent from the following description of a preferred embodiment thereof and from the accompanying drawings.

SUMMARY OF THE INVENTION

This invention relates in a hand tool for turning a screw, nut, bolt or similar rotatable workpiece and which includes a bottom housing carrying a workpiece engageable part and an upper handle slidable axially relative to the housing between extended and retracted positions. A torque spring, received in communicating cavities of the housing and handle is connected between the housing and handle to resist rotation of the handle in either angular direction from a neutral position. A set of angular stops are provided on the housing and a cooperating set of such stops are provided on the handle. In one axial position of the handle, preferably its extended position, the two sets of angular stops engage one another to prevent angular rotation between the handle and bottom housing. Therefore, in this case, hand torque is transmitted directly from the handle to the housing and to the workpiece engaging part. In the other position of the handle, the two sets of angular stops are disengaged so that hand torque applied to the handle is transmitted to the housing through the torque spring, thereby allowing a measured amount of torque to be applied to the workpiece by observing the angular displacement between the handle and the housing. Also, before being applied to a workpiece, the tool may be preloaded with a predetermined amount of torque by shifting the handle to the axial position at which the angular stops are disengaged, twisting the housing and handle by hand to angularly displace them a given amount from their neutral angular position, and then axially shifting the handle to engage the angular stops to hold the housing and handle in the angular position to which they were twisted. Then, when the tool is applied to a workpiece and the handle shifted to disengage the angular stops the energy stored in the torque spring will rotate the housing and the workpiece relative to the handle. Preferably, the handle is spring biased axially to its extended position and the angular stops are engaged at this extended position. Therefore, when the tool is applied to a workpiece a direct drive between the handle and the workpiece will be obtained so long as little axial pressure is applied to the handle and the torque spring may be brought into play quickly and easily by merely applying greater axial pressure, or push, to the handle to shift it to its retracted position.

DETAILED DESCRIPTION OF THE PREFERRED EMBODIMENT

Figure 1:
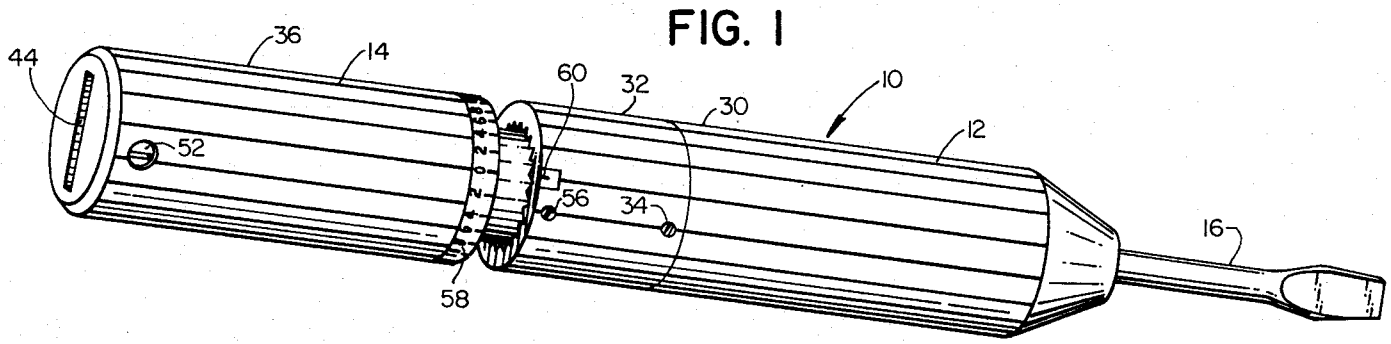
FIG. 1 is a perspective view of a hand tool embodying this invention.

FIG. 1 shows a tool, indicated generally at 10, embodying the present invention. As shown by this figure the tool is generally cylindrical in shape and comprises a bottom housing 12, a handle 14 and a workpiece engageable part 16. The workpiece engageable part is attached to the lower end of the housing 12 for rotation therewith and in the present instance is shown to be a screw driver bit permanently fixed to the housing 12. It should be understood, however, that this part may take various different shapes and forms depending on the workpiece with which it is to be used. It may also be connected to the housing 12 in various different ways and, if desired, a releasable connection may be provided at the lower end of the housing to allow any one of a number different workpiece engageable parts to be quickly connected to or removed from the housing. Both the housing and the handle 14 are preferably made from a suitable plastic which may be molded or machined to the desired form, but they may also be made from a suitable metal if desired.

Figure 2:
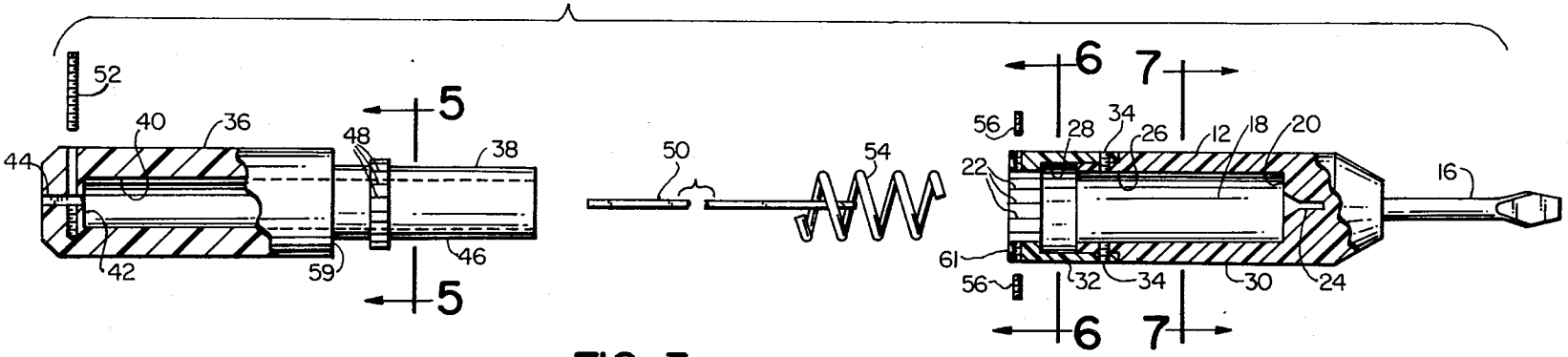
FIG. 2 is an exploded view of the hand tool of FIG. 1 with portions of the handle and bottom housing being shown broken away to reveal their inner construction.
Figures 5, 6, 7, 8, 9, 10, 11, 12:
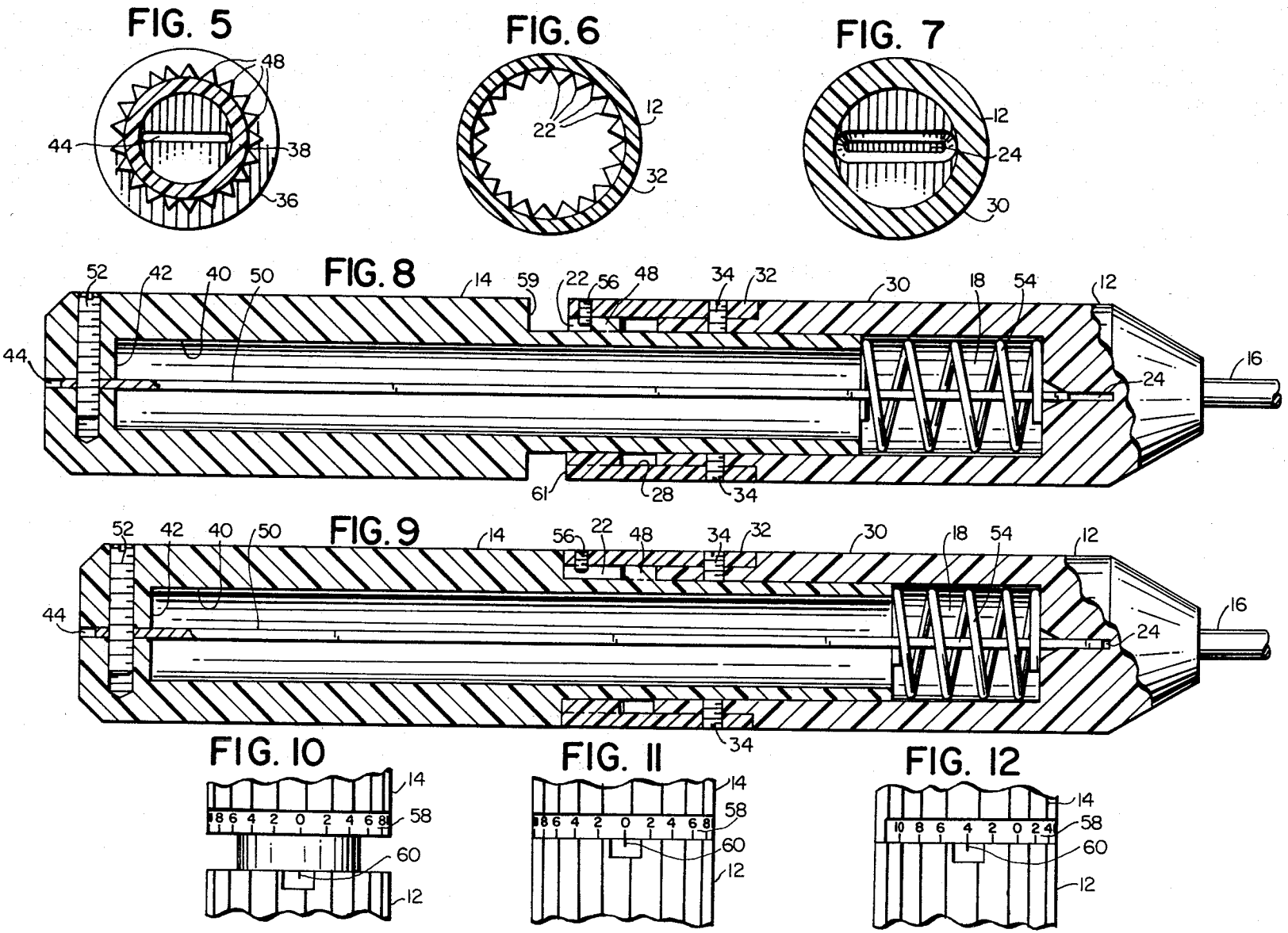
FIG. 5 is a cross-sectional view taken on the line 5—5 of FIG. 2.
FIG. 6 is a cross-sectional view taken on the line 6—6 of FIG. 2.
FIG. 7 is a cross-sectional view taken on the line 7—7 of FIG. 2.
FIG. 8 is primarily a longitudinal sectional view taken through the tool of FIG. 1 with the handle being shown in its extended position relative to the bottom housing.
FIG. 9 is a view similar to FIG. 8 but with the handle being shown in its retracted position relative to the bottom housing.
FIG. 10 is a fragmentary elevational view of the tool of FIG. 1 showing the scale for measuring the amount of torque transmitted between the handle and bottom housing and with the handle being shown in its extended position.
FIG. 11 is similar to FIG. 10 but shows the handle shifted to its retracted position.
FIG. 12 is similar to FIG. 11 but shows the handle twisted relative to the bottom housing to apply a measured amount of torque to the workpiece.

As shown best in FIGS. 2, 8 and 9, the bottom housing 12 has an axial cavity 18 extending downwardly from its upper end (that is, the left-hand end in FIG. 2) and terminating in an upwardly facing bottom cavity surface 20. The cavity 18 is generally cylindrical in shape and at its upper end the housing includes a circular set or array of angular stops in the form of a plurality of teeth 22, 22, shown best in FIG. 6. At the bottom of the cavity 18 the housing includes a generally rectangular slot 24, shown best in FIG. 7.

The cavity 18 has a lower portion 26 of uniform diameter and, between the teeth 22 and the portion 26, includes another portion 28 having a diameter larger than that of the portion 26. The housing 12 may be made as a single unitary part, but preferably and as shown, to facilitate the formation of the teeth 22 and the enlarged diameter portion 28, it is made of two parts 30 and 32 which telescopically overlap and are fixed to one another by screws 34, 34 as shown in FIG. 2.

The handle 14 includes an upper grip portion 36 and a lower shank portion 38. An axial cavity 40 extends upwardly from the lower end of the handle and terminates in an upper cavity surface 42, with the handle above the surface 42 having a rectangular slot 44 which extends to and communicates with the very upper end of the handle as shown best in FIG. 1. The lower end portion 46 of the handle shank 38 is cylindrical in shape and is axially and angularly slidably received by the cylindrical portion 26 of the housing cavity 18. Above the portion 46 is a set of angular stops in the form of a circular set or array of teeth 48, 48, shown best in FIG. 5, cooperable with the teeth 22, 22 of the housing.

Figure 3:
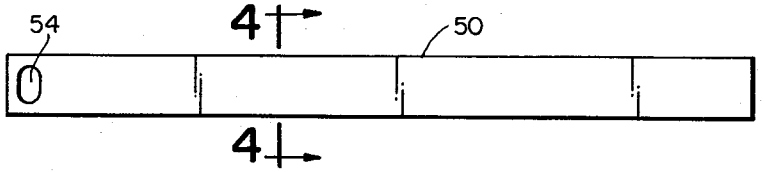
FIG. 3 is a plan view of the torque spring used in the hand tool of FIG. 1.
Figure 4:
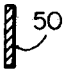
FIG. 4 is a cross-sectional view taken on the line 4—4 of FIG. 3.

Extending from the upper end of the handle 14 to the lower end of the housing 12, and received in the cavities 40 and 18 of the handle and housing, is a torque spring 50 having a rectangular shape and cross section as shown in FIGS. 3 and 4. At its lower end the spring 50 is axially slidably received in the slot 24, and at its upper end it is received in the slot 44 of the handle where it is axially held in place by a screw 52 threaded into the handle and passing through an opening 54 in the upper end of the spring. Therefore, from FIGS. 8 and 9 it will be obvious that in the assembled tool when the handle and housing are moved axially toward and away from one another such movement is accompanied by sliding movement of the lower end of the spring 50 in the slot 24. Also, by removing the screw 52 the spring 50 may be easily removed from the tool, by sliding it out through the slot 44 in the upper end of the handle, and a new spring with a different spring constant may be inserted to change the torque characteristics of the tool.

The handle 14 is telescopically related to the housing 12 and is shiftable axially relative to the housing 12 between an extended position, as shown in FIG. 8, and a retracted position, as shown in FIG. 9. Various different means may be used to releasably or yieldingly hold the handle in either one or both of these positions. However, as shown in FIGS. 2, 8 and 9 this means preferably includes a helical spring 54 received in the lower end of the housing cavity 18, surrounding the torsion spring 50 and working between the bottom surface 20 of the cavity and the lower end of the handle shank 38.

Coengageable stop means are provided on the housing 12 and on the handle 14 for limiting the axial sliding movement of the handle relative to the housing to movement between the extended and retracted positions shown in FIGS. 8 and 9. As illustrated, these means include a pair of set screws 56, 56 threaded into the housing 12 and engageable with the upper ends of the teeth 48, 48 to prevent the handle from moving upwardly beyond the extended position shown in FIG. 8. These means also include the shoulder 59 on the lower end of the grip portion of the handle and the end surface 61 of the housing, which shoulder 59 and surface 61 are coengageable, as shown in FIG. 9, to prevent the handle from moving downwardly relative to the housing beyond the retracted position of FIG. 9.

The housing teeth 22 and the handle teeth 48 are so located on their respective parts that when the handle is in the retracted position of FIG. 9 the two sets of teeth engage or intermesh with one another to prevent angular rotation of the handle relative to the housing. Thus, when the handle is in this extended position, hand torque applied to the handle is transmitted directly to the housing, through the interengaging teeth, to the workpiece. On the other hand, when the handle is in its retracted position relative to the housing, as shown in FIG. 9, the handle teeth are out of engagement with the housing teeth 22 with the handle teeth 48 then residing in the enlarged diameter portion 28 of the housing cavity, so that the handle is freed to rotate relative to the housing. Such relative rotation is, however, resisted by the torsion spring 50 with the result that as the handle is displaced farther and farther from its neutral angular position relative to the housing an increasing amount of torque is transmitted from the handle to the workpiece, and the amount of transmitted torque may be measured by observing the displacement of the handle relative to the housing. To facilitate this observation, the handle is provided with a scale 58 having a graduated set of index marks adjacent the lower end of the grip portion, and the housing is provided with an associated single index mark 60. Thus, by observing the position of the index mark 60 relative to the scale 58 the amount of transmitted torque can be easily visualized.

Having now described the structure of the tool 10 shown by the drawings, its operation may be described as follows. The helical spring 54 normally holds the handle 14 in the extended position shown in FIGS. 1 and 8 and in this position the angular stop teeth 22 of the housing and the angular stop teeth 48 of the handle are engaged to prevent angular rotation between the handle and the housing. Therefore, if the tool is applied in this condition to a workpiece and the handle rotated without pressing it axially, a direct drive between the handle and the workpiece will be achieved, the tool thus serving as a conventional screw driver, socket wrench or the like.

Another mode of operation of the tool 10 may be achieved by applying it to a workpiece and pushing downwardly on the handle 14 to shift the handle to the retracted position shown in FIG. 9. In this position the angular stop teeth 22 and 48 are disengaged from one another and the handle freed to rotate relative to the housing against the bias of the torsion spring 50. The handle may be rotated in either direction from its neutral position and as the applied torque is increased the angular displacement between the handle and the housing will also increase and be measurable through the use of the scale 58 and index mark 60. Thus, in this mode of operation the tool may be used to apply a predetermined amount of torque to a screw, nut or other workpiece with which the tool is used, and the torque is gradually applied to the workpiece.

In a third mode of operation, the tool may be used to receive a preloaded amount of torque which is thereafter releasable while the tool is in engagement with a workpiece to rotate the workpiece without rotating the handle. In this mode of operation the tool is first grasped by both hands of a user with one hand gripping the handle and the other the housing. The housing and handle are then pushed toward one another to bring the handle to its retracted position at which the angular stop teeth 22 and 48 are disengaged from one another. The handle and housing are then twisted, in one or the other direction, to a point at which a desired amount of torque exists between the handle and the housing, as may be measured by observing the scale 58 and index mark 60. When the desired degree of torque is reached the handle is again slid axially relative to the housing to its extended position at which the angular stop teeth 22 and 48 are brought back into locking relationship. The tool may then be applied to a workpiece and the handle pushed inwardly. As the handle is pushed inwardly, the angular stop teeth 22 and 48 eventually become disengaged, and when this disengagement occurs the energy preloaded into the torsion spring 50 drives the housing 12 relative to the handle to rotate the workpiece without the handle itself being rotated. If the spring constant of the torsion spring 50 is relatively high, the rotation of the housing achieved as the angular stop teeth 22 and 48 become disengaged is in the nature of a sharp impact and in many cases can be beneficially used in the final setting of a screw, nut or the like or to break free a screw or nut in a workpiece loosening operation. If the torsion spring 50 has a relatively low spring constant then the housing may be turned a relatively large angular amount relative to the handle before the handle and housing are angularly locked. Therefore, in this case, when the tool is applied to a workpiece and the handle shifted to its retracted position a relatively large angular rotation of the housing may be obtained, as is useful for loosening or tightening workpieces in limited space situations where it is difficult or impossible to rotate the handle in a conventional manner.

It will, of course, be understood that the large number of stop teeth 22 on the housing and stop teeth 48 on the handle allow the handle and housing to be angularly locked relative to one another in any one of a large number of different positions. FIGS. 10, 11 and 12 show more clearly the use of the scale 58 and index mark 60 in measuring the amount of torque transmitted between the handle and housing. FIG. 10 shows the handle and housing in a neutral angular position with the handle in its extended position at which the handle is angularly locked relative to the housing. In FIG. 11 the handle is shifted from its FIG. 10 position to its retracted position at which the handle may now be rotated relative to the housing, and FIG. 12 shows the handle rotated from its neutral position by an amount readily measurable from the sale 58.

We claim:

1. A hand tool for turning a screw, nut, bolt or other rotatable workpiece, said tool comprising a bottom housing having a workpiece engageable part, a handle located above said bottom housing, means connecting said handle to said bottom housing for angular and axial sliding movement of said handle relative to said housing, coengageable stops on said housing and on said handle for limiting the axial sliding movement of said handle relative to said housing to movement between an extended position and a retracted position, a torsion spring connected between said housing and said handle for angularly biasing said handle to a neutral angular position relative to said housing and for yieldingly resisting rotation of said handle relative to said housing in either direction away from said neutral position, and angular stop means on said housing and cooperable angular stop means on said handle, said angular stop means of said housing and said angular stop means of said handle being engageable with one another in any one of a plurality of angular positions of said handle relative to said housing when said handle is in one of said extended or retracted positions to prevent rotation of said handle relative to said housing, and said angular stop means of said housing and said angular stop means of said handle being out of engagement with one another when said handle is in the other of said extended or retracted positions to permit said handle to rotate relative to said housing.

2. A hand tool as defined in claim 1 further characterized by a means for biasing said handle to said extended position relative to said housing and for yieldingly resisting axial movement of said handle from said extended position toward said retracted position, said angular stop means on said housing and said angular stop means on said handle being arranged so as to be engaged with one another when said handle is in said extended position and so as to be disengaged from one another when said handle is in said retracted position.

3. A hand tool as defined in claim 2 further characterized by said handle and said housing being telescopically connected to one another and having communicating cavities, said angular biasing means being a torsion spring located within said communicating cavities and having one end connected to said housing and another end connected to said handle.

4. A hand tool as defined in claim 3 further characterized by said torsion spring being of noncircular cross section, said spring having its lower end axially slidably received in a conforming slot of said housing and its upper end axially slidably received in a conforming slot of said handle, and means releasably axially fixing one end of said torsion spring to the associated one of said handle and housing, said handle slot extending from said communicating cavities to the very upper end of said handle so that when said axial fixing means is released said torsion spring may be removed from said tool by being slid through said handle slot.

5. A hand tool for turning a screw, nut, bolt or other rotatable workpiece, said tool comprising a bottom housing having a lower end and an upper end and having a cavity extending into said housing from said upper end thereof to a bottom cavity end surface located below said upper end, a workpiece engageable part attached to said lower end of said housing for rotation therewith, a handle having a grip portion adapted to be gripped by the hand of a user and located above said upper end of said housing, said handle also having a shank portion extending downwardly from said grip portion and received at least in part by said housing cavity for both angular and axial sliding movement relative to said housing, said handle having a cavity extending axially upwardly from the lower end of said shank portion to an upper cavity end surface, coengageable stops on said housing and on said handle for limiting the axial sliding movement of said handle relative to said housing to movement between an extended position and a retracted positions, a spring working between said housing and said handle for urging said handle to said extended position relative to said housing and for yieldingly resisting its movement toward said retracted position, a torsion spring located within said cavity of said housing and said cavity of said handle, means angularly fixing said torsion spring at its bottom end to said housing and at its upper end to said handle while permitting said torsion spring to axially slide relative to at least one of said housing and handle, said torsion spring angularly biasing said handle to a neutral angular position relative to said housing and yieldingly resisting rotation of said handle relative to said housing in either direction away from said neutral position, and angular stop means on said housing and cooperable angular stop means on said handle, said angular stop means of said housing and said angular stop means of said handle being engageable with one another in any one of a plurality of different angular positions of said handle relative to said housing when said handle is in one of said extended or retracted positions to prevent rotation of said handle relative to said housing, and said angular stop means of said housing and said angular stop means of said handle being out of engagement with one another when said handle is in the other of said extended or retracted positions to permit said handle to rotate relative to said housing.

6. A hand tool as defined in claim 5 further characterized by said spring for urging said handle to said extended position being a helical spring located in said housing cavity, surrounding said torsion spring and working between said bottom cavity end surface and the lower end of said handle shank portion.

7. A hand tool as defined in claim 5 further characterized by said torsion spring being of noncircular cross section, said means for angularly fixing said torsion spring at its bottom end to said housing and at its upper end to said handle comprising a lower slot of corresponding noncircular cross section in said housing extending downwardly from said bottom cavity end surface and an upper slot of corresponding noncircular cross section in said handle extending upwardly from said upper cavity end surface, said torsion spring having its lower end axially slidably received in said lower slot and its upper end axially slidably received in said upper slot, and means axially fixing one end of said torsion spring to the associated one of said handle and housing.

8. A hand tool as defined in claim 7 further characterized by said means for axially fixing one end of said torsion spring to the associated one of said handle and housing being releasable, and said handle slot extending upwardly from said upper cavity end surface to the very upper end of said handle so that when said axial fixing means is released said torsion spring may be removed from said tool by being slid through said handle slot.

9. A hand tool as defined in claim 8 further characterized by said means for axially fixing one end of said torsion spring being a screw threaded into said associated one of said handle and housing and passing through a lateral opening in said torsion spring.

10. A hand tool as defined in claim 5 further characterized by said angular stop means on said housing being a circular array of teeth fixed to said housing, and said angular stop means on said handle being a cooperable circular array of teeth fixed to said handle.

* * * * *